US011022148B2

(12) United States Patent
Hollan

(10) Patent No.: US 11,022,148 B2
(45) Date of Patent: Jun. 1, 2021

(54) FAN MOUNTING SYSTEM

(71) Applicant: DELTA T, LLC, Lexington, KY (US)

(72) Inventor: C. Jason Hollan, Lexington, KY (US)

(73) Assignee: DELTA T, LLC, Lexington, KY (US)

( * ) Notice: Subject to any disclaimer, the term of this patent is extended or adjusted under 35 U.S.C. 154(b) by 1457 days.

(21) Appl. No.: 14/439,801

(22) PCT Filed: Oct. 29, 2013

(86) PCT No.: PCT/US2013/067275
§ 371 (c)(1),
(2) Date: Apr. 30, 2015

(87) PCT Pub. No.: WO2014/070747
PCT Pub. Date: May 8, 2014

(65) Prior Publication Data

US 2015/0260199 A1 Sep. 17, 2015

Related U.S. Application Data

(60) Provisional application No. 61/720,077, filed on Oct. 30, 2012.

(51) Int. Cl.
*F04D 29/64* (2006.01)
*F04D 25/08* (2006.01)
*F04D 29/60* (2006.01)

(52) U.S. Cl.
CPC ..... *F04D 29/646* (2013.01); *F04D 25/088* (2013.01); *F04D 29/601* (2013.01); *Y10T 29/49245* (2015.01)

(58) Field of Classification Search
USPC ..... 416/5, 194, 195, 244 R; 248/228.1, 248/228.3, 343, 903
See application file for complete search history.

(56) References Cited

U.S. PATENT DOCUMENTS 3,124,330 A * 3/1964 Robinson ..... E04G 7/26 248/228.2
4,064,427 A * 12/1977 Hansen ..... F21S 8/065 362/96
4,560,321 A * 12/1985 Kawai ..... F04D 29/362 416/162
5,085,392 A * 2/1992 Perna ..... E04B 9/006 248/27.1
5,711,397 A * 1/1998 Flora ..... A62B 35/0081 182/3
6,619,919 B2 9/2003 Kerr
6,709,238 B2 * 3/2004 Marshall ..... F04D 25/088 403/291
6,881,037 B2 4/2005 Marshall
(Continued)

*Primary Examiner* — Bradley Duckworth
(74) *Attorney, Agent, or Firm* — King & Schickli, PLLC

(57) ABSTRACT

A fan mounting system (30) may include supplemental mounting components for installations where fan (10) will be located in a geographic region that encounters frequent seismic activity. These supplemental components may provide additional reinforcement and stability to fan (10), enabling fan (10) to remain secured to a ceiling or other structure during seismic events. Such a supplemental system may comprise cables (410) extending between and connecting the fan (10) to structures, such as ceiling joists (450). Related methods are also disclosed.

22 Claims, 7 Drawing Sheets

(56) References Cited

U.S. PATENT DOCUMENTS

| | | | | |
|---|---|---|---|---|
| 7,625,186 | B1 * | 12/2009 | Lueddecke | F04D 25/088 416/243 |
| 8,480,041 | B2 * | 7/2013 | Myers | F16B 2/12 24/16 R |
| 8,931,747 | B2 * | 1/2015 | Davis | F16B 1/00 248/214 |
| 2004/0195479 | A1 * | 10/2004 | Gulley | F16B 2/12 248/228.1 |
| 2005/0189456 | A1 * | 9/2005 | Hoffmann | E04B 9/18 248/228.1 |
| 2006/0024127 | A1 | 2/2006 | Heath | |
| 2007/0090242 | A1 * | 4/2007 | Gulley | G09F 7/18 248/228.1 |
| 2008/0107527 | A1 | 5/2008 | Gajewski | |
| 2009/0152426 | A1 | 6/2009 | Longton et al. | |

* cited by examiner

FAN MOUNTING SYSTEM

This application claims the benefit of U.S. Provisional Patent Application Ser. No. 61/720,077, the disclosure of which is incorporated herein by reference.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in U.S. Pat. Pub. No. 2008/0008596, entitled "Fan Blades," published Jan. 10, 2008; U.S. Pat. Pub. No. 2009/0208333, entitled "Ceiling Fan System with Brushless Motor," published Aug. 20, 2009; and U.S. Pat. Pub. No. 2010/0278637, entitled "Ceiling Fan with Variable Blade Pitch and Variable Speed Control," published Nov. 4, 2010, the disclosures of which are also incorporated by reference herein. It should be understood that teachings herein may be incorporated into any of the fans described in any of the above-referenced patents, publications, or patent applications.

A fan blade or airfoil may include one or more upper air fences and/or one or more lower air fences at any suitable position(s) along the length of the fan blade or airfoil. Merely exemplary air fences are described in U.S. patent application Ser. No. 12/889,475, entitled "Air Fence for Fan Blade," filed Sep. 24, 2010, the disclosure of which is incorporated by reference herein. Alternatively, any other suitable type of component or feature may be positioned along the length of a fan blade or airfoil; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pat. Pub. No. 2008/0014090, entitled "Cuffed Fan Blade Modifications," published Jan. 17, 2008, filed Sep. 25, 2007, the disclosure of which is incorporated by reference herein. Still other exemplary winglets are described in U.S. Pat. No. 0,587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pat. Pub. No. 2008/0213097, entitled "Angled Airfoil Extension for Fan Blade," published Sep. 4, 2008, the disclosure of which is incorporated by reference herein. Other suitable structures that may be associated with an outer tip of an airfoil or fan blade will be apparent to those of ordinary skill in the art. Alternatively, the outer tip of an airfoil or fan blade may be simply closed with a cap or otherwise, etc.), or may lack any similar structure at all.

The interface of a fan blade and a fan hub may also be provided in a variety of ways. For instance, an interface component is described in U.S. Pat. Pub. No. 200910081045, entitled "Aerodynamic Interface Component for Fan Blade," published Mar. 26, 2009, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Pat. Pub. No. 200910072108, entitled "Ceiling Fan with Angled Mounting," published Mar. 19, 2009, the disclosure of which is incorporated herein. Of course, a fan need not be mounted to a ceiling or other overhead structure, and instead may be mounted to a wall or to the ground. For instance, a fan may be supported on the top of a post that extends upwardly from the ground. Alternatively, any other suitable mounting structures and/or mounting techniques may be used in conjunction with embodiments described herein.

It should also be understood that a fan may include sensors or other features that are used to control, at least in part, operation of a fan system. For instance, such fan systems are disclosed in U.S. Pat. Pub. No. 2009/0097975, entitled "Ceiling Fan with Concentric Stationary Tube and Power-Down Features," published Apr. 16, 2009, the disclosure of which is incorporated by reference herein; U.S. Pat. Pub. No. 2009/0162197, entitled "Automatic Control System and Method to Minimize Oscillation in Ceiling Fans," published Jun. 25, 2009, the disclosure of which is incorporated by reference herein; U.S. Pat. Pub. No. 201010291858, entitled "Automatic Control System for Ceiling Fan Based on Temperature Differentials," published Nov. 18, 2010, the disclosure of which is incorporated by reference herein; and U.S. Provisional Patent App. No. 61/165,582, entitled "Fan with Impact Avoidance System Using Infrared," filed Apr. 1, 2009, the disclosure of which is incorporated by reference herein. Alternatively, any other suitable control systems/features may be used in conjunction with embodiments described herein.

In some settings, it may be desirable to replicate or approximate the function of a winglet in a component that may be located at a position on a fan blade other than at the free end of the fan blade. For instance, such components are disclosed in U.S. Pat. Pub. No. 2011/0081246, entitled "Air Fence For Fan Blade," published Apr. 7, 2011, the disclosure of which is incorporated by reference herein. Such a component may provide an effect on fan efficiency similar to the effect provide by a winglet, albeit at one or more additional regions of the fan blade. In particular, such a component or accessory may serve as an aerodynamic guide or air fence, interrupting slippage of air along the length or longitudinal axis of the fan blade; and redirecting the air flow to a direction perpendicular to the longitudinal axis of the fan blade, above and/or below the fan blade.

While a variety of fans and fan systems have been made and used, it is believed that no one prior to the inventor has made or used a fan mounting system as described herein.

SUMMARY

One aspect of this disclosure pertains to an apparatus for mounting a ceiling fan including a support to one or more ceiling structures. The apparatus comprises a mount adapted for connecting to the ceiling structure and a cable for extending between the ceiling fan and the mount. The cable provides additional reinforcement and stability, enabling the fan to remain secured to the ceiling structure during seismic events.

In one embodiment, a plurality of mounts are provided, each adapted for connecting to one ceiling structure, and a plurality of cables are also provided, each cable for extending between the ceiling fan and one of the mounts. The mount or mounts may comprise a mounting bracket for connecting to one end of the cable, and may comprise a pair of mounting brackets for connecting to the support structure, and an adjustable bar for connecting the mounting brackets. The adjustable bar may include multiple bolt holes, and the brackets may comprise slots adapted for receiving a bolt extending within any of the multiple bolt holes. The mount or mounts may comprise an eye bolt for connecting to a first end of the cable, and a turnbuckle may connect to the ceiling fan at one end and to the cable at the other end.

Another aspect of the disclosure relates to an apparatus for providing air circulation from adjacent a ceiling of a room including joists. The apparatus comprises a fan, a plurality of mounting brackets, each for connecting to one joist, and a plurality of cables, each for connecting the fan to one of the mounting brackets. The cables provide additional reinforcement and stability, enabling the fan to remain secured to the ceiling during seismic events.

In one embodiment, the fan includes a support for supporting the fan from the ceiling. The support may comprise an elongate, metal tube-like structure that couples the fan to the ceiling. The cables may be connected to the fan by way of turnbuckles attached to a bracket located between a motor assembly and a gearbox of the fan.

Each mounting bracket may be adapted to envelop the joist. Specifically, each mounting bracket may comprise an adjustable bar, a pair of brackets, an eye bolt, bolts, and nuts. Each of the brackets may include a slot for receiving one of the bolts. The fan may comprise a hub assembly and fan blades, together having a diameter of between approximately 6 feet and approximately 24 feet.

Each joist may comprise a pair of opposed angle-iron members, in which case the mounting bracket comprises generally L-shaped brackets for being arranged in an opposing relationship over the angle-iron members, and further including a fastener for connecting the L-shaped brackets together. The fastener may comprise a bolt or an adjustable bar.

Another aspect of this disclosure pertains to a mounting bracket for connecting with a cable extending between a support structure and a fan. The mounting bracket comprises first and second brackets, each including a first leg and a second leg. First fasteners are provided for connecting with each of the first legs of the brackets, along with a bar for connecting to the first fasteners. At least one second fastener is provided for connecting with the second legs, along with at least one connector for connecting with the cable.

Each first leg may include at least one first aperture and each second leg may include at least one second aperture. The first fasteners are for positioning in the first apertures and the second fastener is for positioning in the second apertures. The second fastener may comprise an bolt having a shank for passing through the second apertures, which the bolt may include the connector. The bar may comprise a plurality of holes for receiving the first fasteners. The holes may be tapped. The first apertures may comprise slots, and the apparatus may further include nuts for connecting to the ends of the first fasteners.

A further aspect of the disclosure pertains to an improvement for use in connection with a fan for circulating air, comprising a seismic event protection kit including a plurality of mounting brackets. Each bracket is adapted for connecting to a ceiling joist, and a plurality of cables are provided for extending between the fan and the mounting brackets to provide additional reinforcement and stability, thereby enabling the fan to remain secured in place during seismic events.

Still a further aspect of this disclosure pertains to a method for mounting a fan supported by a structure to a support connected to the structure. The method comprises securing a mounting bracket to the support, and extending a cable between the fan and the mounting bracket. The cable provides additional reinforcement and stability, enabling the fan to remain secured in place during seismic events. The method may further include securing a plurality of mounting brackets to a plurality of supports, and extending a cable between the fan and each mounting bracket.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
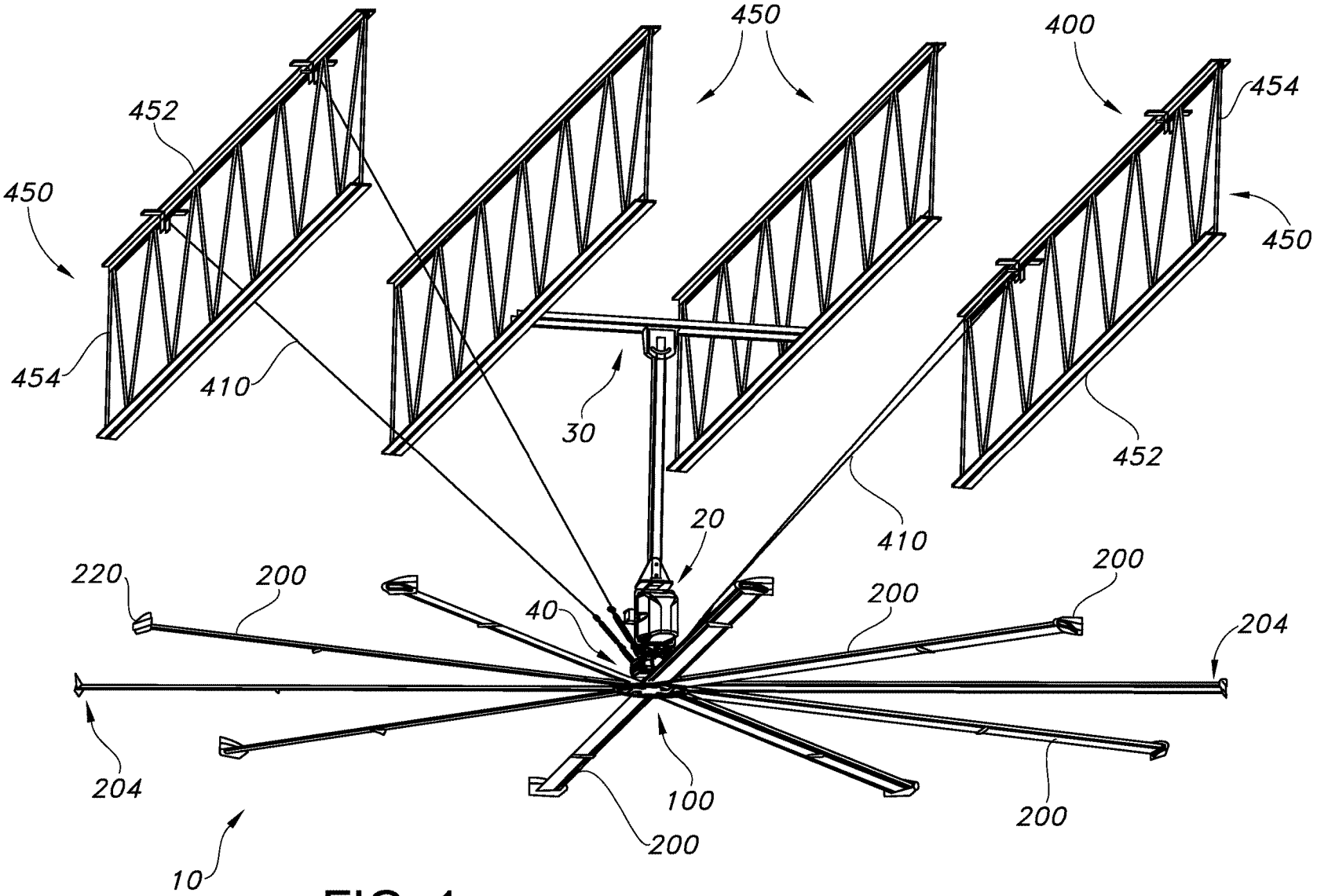
FIG. 1 depicts a perspective view of an exemplary fan having a motor assembly, a hub assembly, a support, a plurality of fan blades, and a mounting system coupled with joists.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which includes by way of illustration, one or more of the best modes contemplated for carrying out the invention. As will be realized, the invention is capable of other different and obvious aspects, all without departing from the invention.

Accordingly, the drawings and descriptions should be regarded as illustrative in nature and not restrictive.

I. Exemplary Fan Overview

Referring to FIG. 1, a fan (10) of the present example comprises a motor assembly (20), a support (30), a hub assembly (100), and a plurality of fan blades (200). In the present example, fan (10) (including hub assembly (100) and fan blades (200)) has a diameter of approximately 8 feet. In other variations, fan (10) has a diameter between approximately 6 feet, inclusive, and approximately 24 feet, inclusive. Alternatively, fan (10) may have any other suitable dimensions.

Support (30) is configured to be coupled to a surface or other structure at a first end such that fan (10) is substantially attached to the surface or other structure. As shown in FIG. 1, one such example of a structure may be a ceiling joist (450). Support (30) of the present example comprises an elongate metal tube-like structure that couples fan (10) to a ceiling, though it should be understood that support (30) may be constructed and/or configured in a variety of other suitable ways as will be apparent to one of ordinary skill in the art in view of the teachings herein. By way of example only, support (30) need not be coupled to a ceiling or other overhead structure, and instead may be coupled to a wall or to the ground. For instance, support (30) may be positioned on the top of a post that extends upwardly from the ground. Alternatively, support (30) may be mounted in any other suitable fashion at any other suitable location. This includes, but is not limited to, the teachings of the patents, patent publications, or patent applications cited herein. By way of example only, support (30) may be configured in accordance with the teachings of U.S. Pat. Pub. No. 2009/0072108, entitled "Ceiling Fan with Angled Mounting," published Mar. 19, 2009, the disclosure of which is incorporated by reference herein. As yet another alternative, support (30) may have any other suitable configuration. Furthermore, support (30) may be supplemented in numerous ways. One merely illustrative example is described in detail below, while other examples and variations will be apparent to those of ordinary skill in the art in view of the teachings herein.

Motor assembly (20) of the present example comprises an AC induction motor having a drive shaft, though it should be understood that motor assembly (20) may alternatively comprise any other suitable type of motor (e.g., a permanent magnet brushless DC motor, a brushed motor, an inside-out motor, etc.). In the present example, motor assembly (20) is fixedly coupled to support (30) and rotatably coupled to hub assembly (100). Furthermore, motor assembly (20) is operable to rotate hub assembly (100) and the plurality of fan blades (200). By way of example only, motor assembly (20) may be constructed in accordance with at least some of the teachings of U.S. Pat. Pub. No. 2009/0208333, entitled "Ceiling Fan System with Brushless Motor," published Aug. 20, 2009, the disclosure of which is incorporated by reference herein. Furthermore, fan (10) may include control electronics that are configured in accordance with at least some of the teachings of U.S. Pat. Pub. No. 2010/0278637, entitled "Ceiling Fan with Variable Blade Pitch and Variable Speed Control," published Nov. 4, 2010, the disclosure of which is incorporated by reference herein. Alternatively, motor assembly (20) may have any other suitable components, configurations, functionalities, and operability, as will be apparent to those of ordinary skill in the art in view of the teachings herein.

Hub assembly (100) may be constructed in accordance with at least some of the teachings of U.S. Patent Application Publication No. 2010/0278637, entitled "Ceiling Fan with Variable Blade Pitch and Variable Speed Control," published Nov. 4, 2010, the disclosure of which is incorporated by reference herein. Alternatively, hub assembly (100) may be constructed in accordance with any of the teachings or other patent references cited herein. Still other suitable ways in which hub assembly (100) may be constructed will be apparent to those of ordinary skill in the art in view of the teachings herein. It should also be understood that an interface component (not shown) may be provided at the interface of each fan blade (200) and hub assembly (100). By way of example only, such an interface component may be configured in accordance with the teachings of U.S. Pat. Pub. No. 2009/0081045, entitled "Aerodynamic Interface Component for Fan Blade," published Mar. 26, 2009, the disclosure of which is incorporated by reference herein. Of course, such an interface component may be omitted if desired.

Fan blades (200) may further be constructed in accordance with some or all of the teachings of any of the patents, patent publications, or patent applications cited herein. For example, fan blades (200) may be configured in accordance with the teachings of U.S. Pat. No. 7,284,960, entitled "Fan Blades," issued Oct. 23, 2007; U.S. Pat. No. 6,244,821, entitled "Low Speed Cooling Fan," issued Jun. 12, 2001; and/or U.S. Pat. No. 6,939,108, entitled "Cooling Fan with Reinforced Blade," issued Sep. 6, 2005. The disclosures of each of those U.S. patents are incorporated by reference herein. As another merely illustrative example, fan blades (200) may be configured in accordance with the teachings of U.S. Pat. Pub. No. 2008/0008596, entitled "Fan Blades," published Jan. 10, 2008, the disclosure of which is also incorporated by reference herein. As yet another merely illustrative example, fan blades (200) may be configured in accordance with the teachings of U.S. Pat. Pub. No. 2010/0104461, entitled "Multi Part Modular Airfoil Section and Method of Attachment Between Parts," published Apr. 29, 2010, the disclosure of which is incorporated by reference herein. Alternatively, any other suitable configurations for fan blades (200) may be used in conjunction with the examples described herein. In the present example, fan blades (200) are formed of aluminum through an extrusion process such that each fan blade has a substantially uniform cross section along its length. It should be understood that fan blades (200) may alternatively be formed using any suitable material, or combination of materials, by using any suitable technique, or combination of techniques, and may have any suitable cross-sectional properties or other properties as will be apparent to one of ordinary skill in the art in view of the teachings herein.

Fan blades (200) of the present example may further include a variety of modifications. By way of example only, fan blade (200) of the present example further comprises a winglet (220) coupled to the second end (204) of fan blade (200). Winglets (220) may be constructed in accordance with some or all of the teachings of any of the patents, patent publications, or patent applications cited herein. For instance, winglets (220) may be configured in accordance with at least some of the teachings of U.S. Pat. No. 7,252,478, entitled "Fan Blade Modifications," issued Aug. 7, 2007, the disclosure of which is incorporated by reference herein. As another merely illustrative example, winglets (220) may be configured in accordance with the teachings of U.S. Pat. Pub. No. 2008/0014090, entitled "Cuffed Fan Blade Modifications," published Jan. 17, 2008, the disclosure of which is incorporated by reference herein. As yet another merely illustrative example, winglets (220) may be configured in accordance with the teachings of U.S. Pat. No. D587,799, entitled "Winglet for a Fan Blade," issued Mar. 3, 2009, the disclosure of which is incorporated by reference herein. Of course, any other suitable configuration for winglets (220) may be used as will be apparent to those of ordinary skill in the art in light of the teachings herein.

It should also be understood that winglet (220) is merely optional. For instance, other alternative modifications for fan blades (200) may include end caps, angled airfoil extensions, integrally formed closed ends, or substantially open ends. By way of example only, an angled extension may be added to the free end of each fan blade (200) in accordance with the teachings of U.S. Pat. Pub. No. 2008/0213097, entitled "Angled Airfoil Extension for Fan Blade," published Sep. 4, 2008, the disclosure of which is incorporated by reference herein. Other suitable structures that may be associated with second end (204) of each fan blade (200) will be apparent to those of ordinary skill in the art in view of the teachings herein.

II. Exemplary Supplement to Mounting System

It may be desirable to provide added support beyond the exemplary mounting system (30) referred to above. By way of example only, an otherwise standard mounting system (30) may include supplemental mounting components for installations where fan (10) will be located in a geographic region that encounters frequent seismic activity. These supplemental components may provide additional reinforcement and stability to fan (10), enabling fan (10) to remain secured to a ceiling or other structure during seismic events. As shown in FIG. 1, such a supplemental system may comprise one or more flexible connectors, such as cables (410), extending between and connecting the fan (10) to structures, such as ceiling joists (450).

Figure 2:
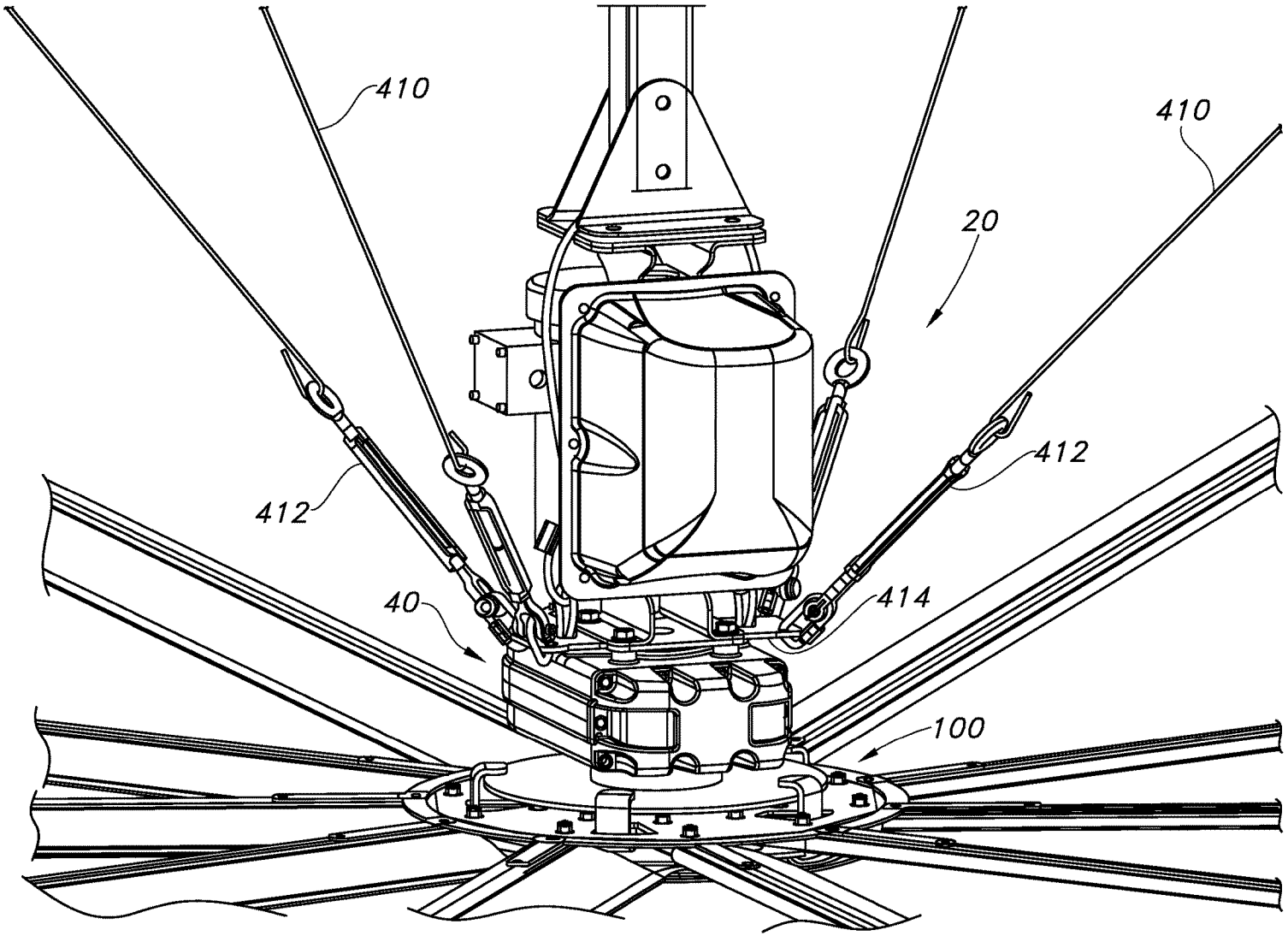
FIG. 2 depicts a detailed perspective view of the fan of FIG. 1, showing the connection between the fan and the mounting system of FIG. 1.

As shown in FIG. 2, the cables (410) may be connected to the fan (10) directly, or as shown by way of adjustable connectors, such as turnbuckles (412). The turnbuckles (412) may be attached to a bracket (414) connected to the fan (10), such as between the motor assembly (20) and the gearbox (40). However, any other suitable structures/methods of connecting the fan (10) to the cables (410) may be used, and the cables (410) may be connected to any of the above mentioned exemplary fans.

Figure 3:
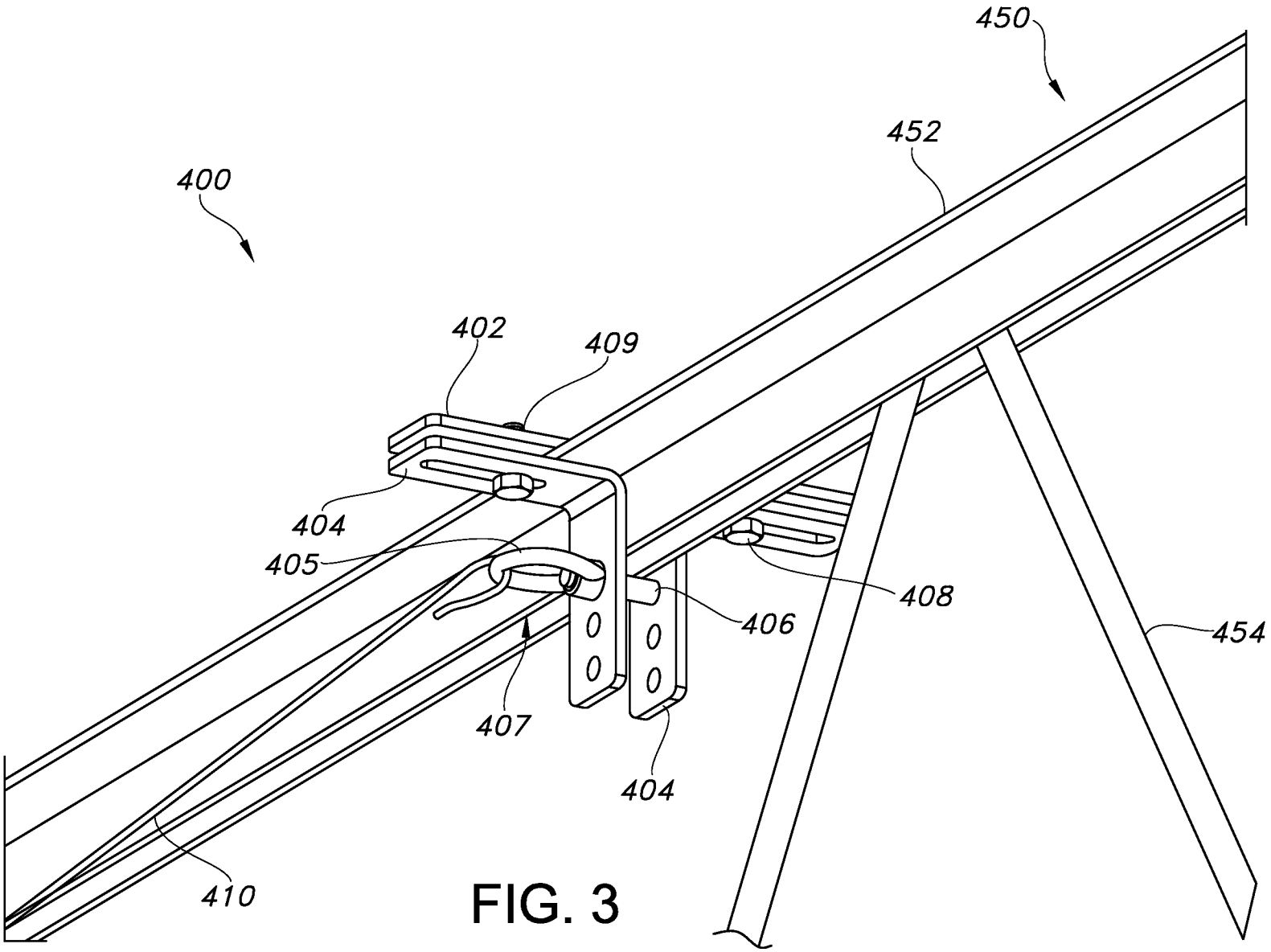
FIG. 3 depicts a detailed perspective view of a mounting bracket of the system of FIG. 1.
Figure 4:
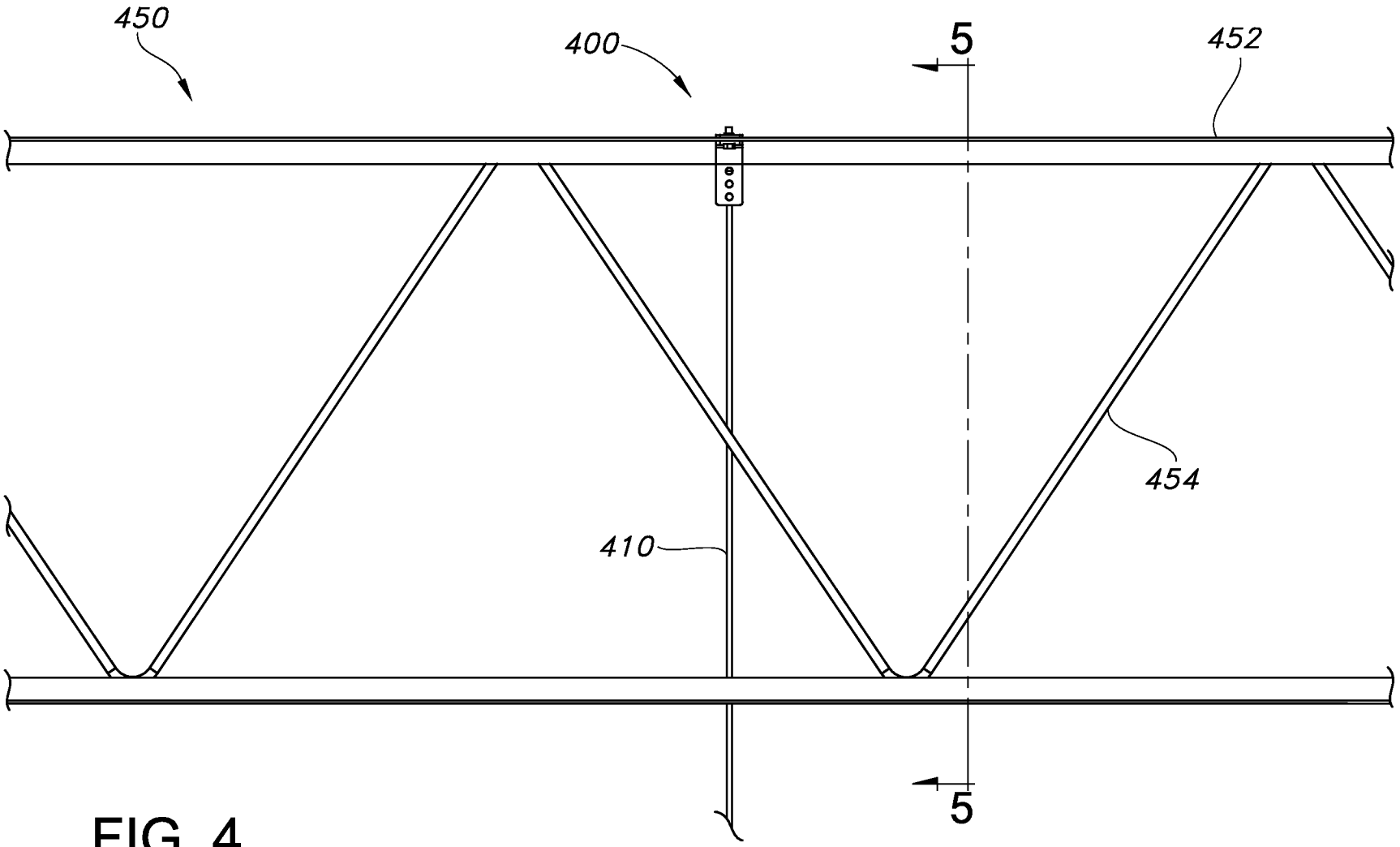
FIG. 4 depicts a side view of a joist of FIG. 1, and the mounting system of FIG. 1.

The cables (410) are also connected to ceiling joists (450) by way of an exemplary mounting bracket (400) as shown in FIGS. 1 and 3. The cable (410) attaches to the mounting bracket (400) by way of a connector, such as an eye bolt (407), as shown in FIG. 3. In the case where the ceiling joists (450) are comprised of web members (454), the angle iron members (452) when assembled form an "I-beam" type structural member as shown in FIGS. 1, 3, 4, and 5. The angle iron members (452) may come in many different widths and depths, depending upon the particular application.

Figure 5:
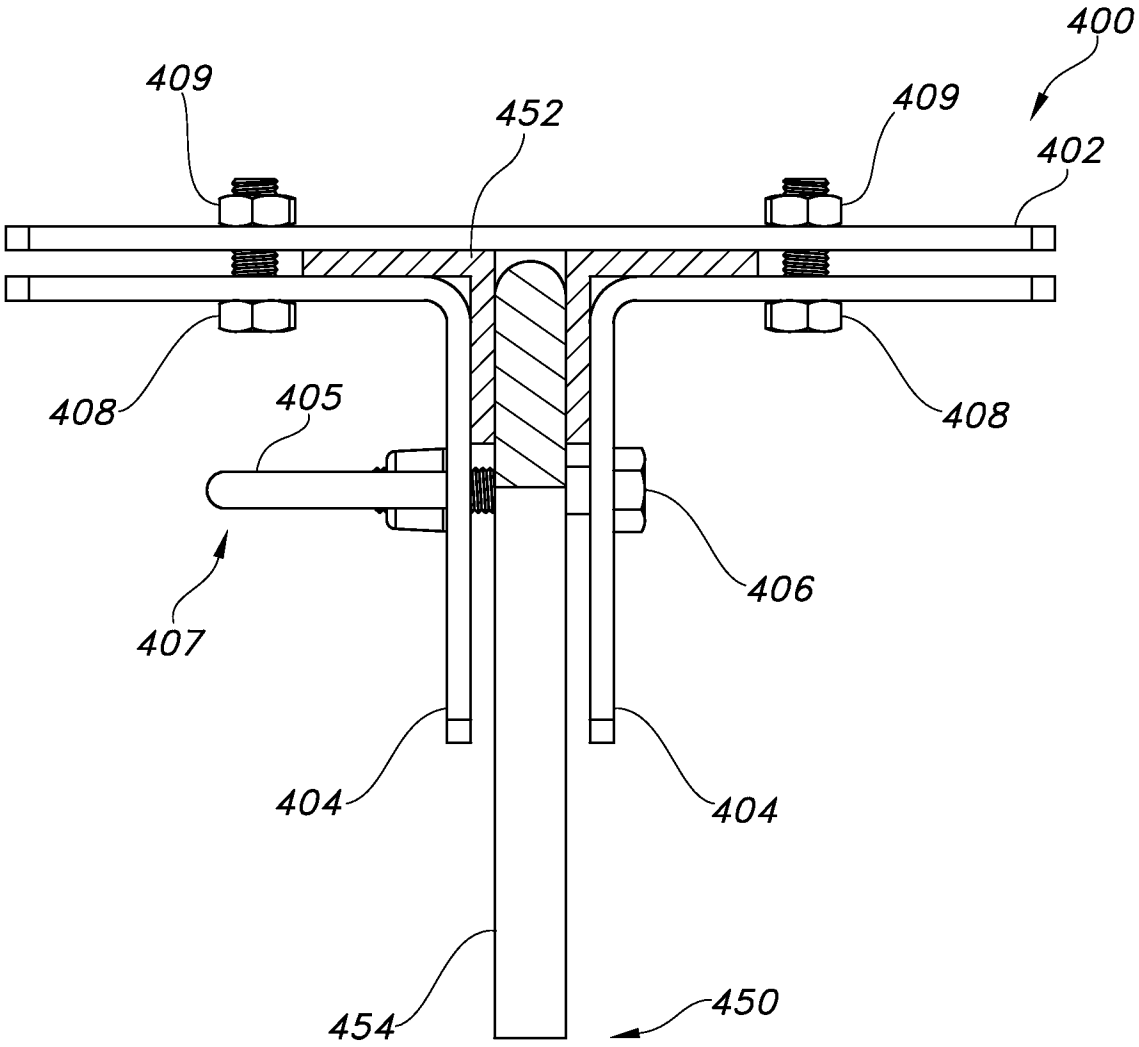
FIG. 5 depicts section view of the joist of FIG. 4, and of the mounting bracket in FIG. 3.
Figure 6:
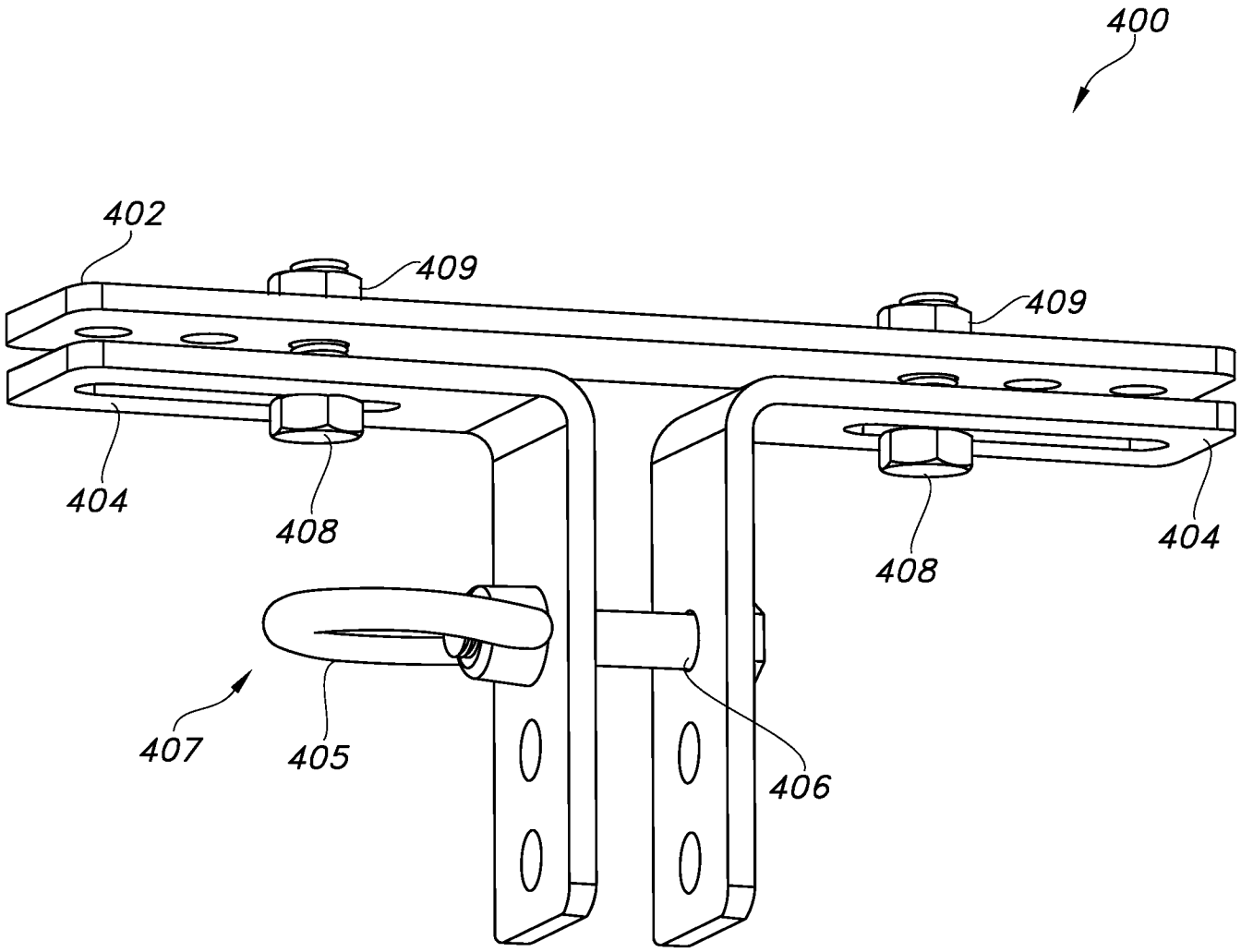
FIG. 6 depicts a perspective view of the mounting bracket of FIG. 3.

As shown in FIGS. 3, 5, 6, and 7; the exemplary mounting bracket (400) comprises an adjustable member, such as bar (402) for connecting brackets (404). The eye bolt (407) may be connected to brackets (404). Bolts (408) and nuts (409) may be used to complete the assembly. When completely assembled, the exemplary mounting bracket (400) envelops a ceiling joist (450) as shown in FIGS. 1, 3, and 5. In such case, the brackets (404) form opposing right angles which complement the "T" shape formed by the angle iron members (452) of the ceiling joist (450) as shown in FIGS. 3 and 5.

The brackets (404) may be placed below the flanges of the angle iron members (452) and coupled together by a fastener, which may comprise a bolt (406) and a separable connector (405), which together form the eye bolt (407) (but a conventional single piece eye bolt with a nut would work as well). An adjustable member (402) is then placed in a position above the flanges of the angle iron members (452) and secured with bolts (408) to the brackets (404) below the flanges of the angle iron members (452) as shown in FIGS. 3 and 5. Although the adjustable member (402) of the exemplary mounting bracket utilizes tapped bolt-holes (405), other configurations may utilize nuts (409) as shown.

Figure 7:
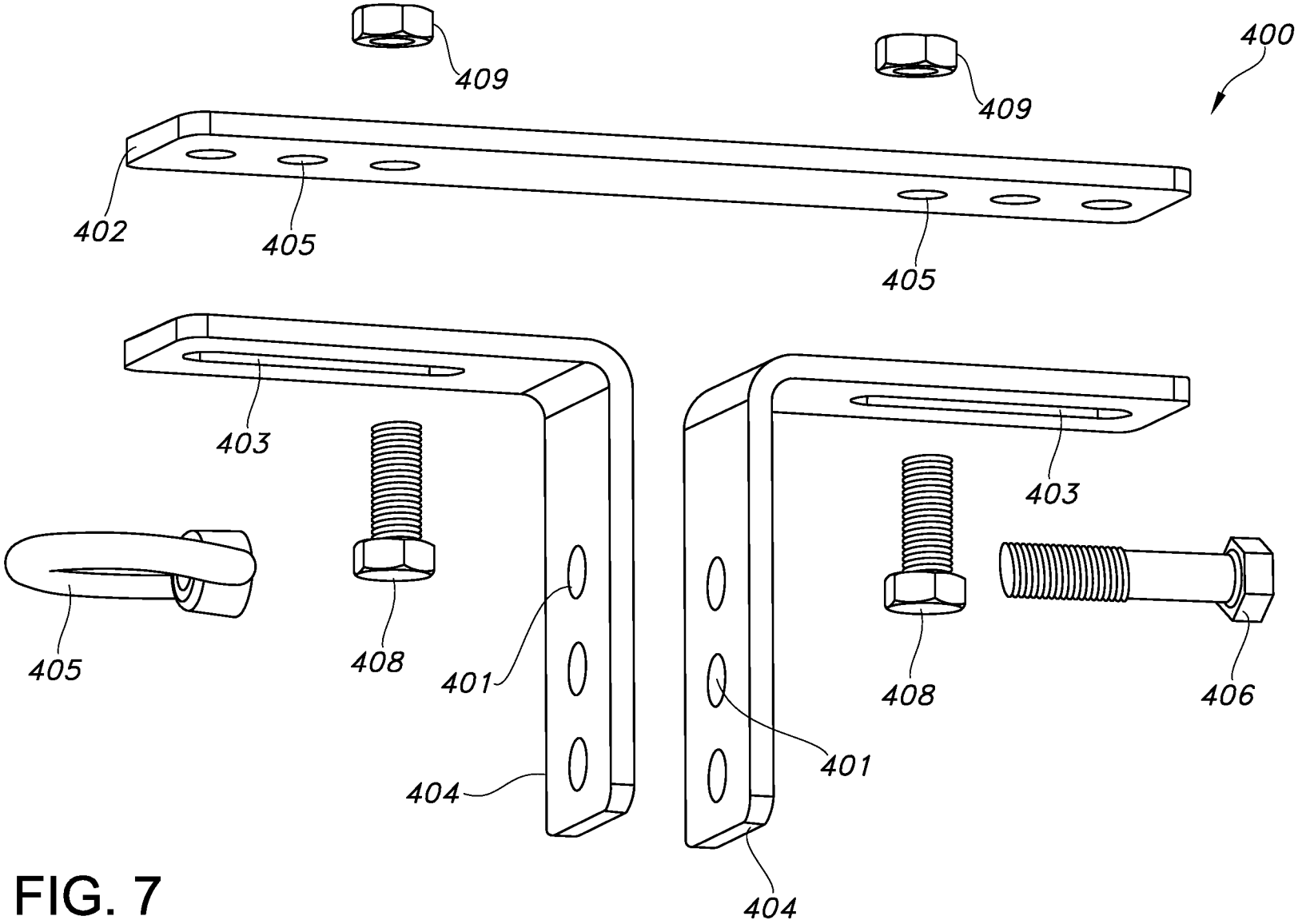
FIG. 7 depicts an exploded view of the mounting bracket of FIG. 6.

Because the angle iron members (452) may come many in different widths and depths, the mounting bracket (400) is adjustable in the present example. As best shown in FIG. 7, bolts (408) may be inserted through the brackets (404) and adjustable bar (402) at several different locations to accommodate multiple angle iron member (452) widths. This is accomplished by providing an elongated slot (403) in the bracket (404) and multiple bolt holes (405) in the adjustable bar (402). Also, an eye bolt (407) may be inserted through the brackets (404) at different positions to accommodate multiple angle iron member (452) depths. This is accomplished by providing multiple bolt holes (401) in the brackets (404).

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the invention should be considered in terms of claims that may be presented, and is understood not to be limited to the details of structure and operation shown and described in the specification and drawings.

The invention claimed is:

1. An apparatus for mounting a ceiling fan including a support to one or more ceiling structures, comprising;

a plurality of mounts, each adapted for connecting to the ceiling structure; and a plurality of cables, each for extending between the ceiling fan and one of the mounts, whereby the cables provide additional reinforcement and stability, enabling the fan to remain secured to the ceiling structure during seismic events, wherein the mounts comprise a pair of mounting brackets, and an adjustable bar for connecting the mounting brackets, wherein the adjustable bar comprises multiple bolt holes, and the brackets comprise slots adapted for receiving a bolt extending within any of the multiple bolt holes.

2. The apparatus of claim 1, wherein the mounts comprise a mounting bracket for connecting to one end of the cable.

3. The apparatus of claim 1, wherein the mounts comprise an eye bolt for connecting to a first end of the cable.

4. The apparatus of claim 1, further including a turnbuckle for connecting to the ceiling fan at one end and to the cable at the other end.

5. The apparatus of claim 1, wherein the ceiling structure comprises a plurality of joists, and each mount is adapted for enveloping a portion of one of the joists.

6. The apparatus of claim 5, wherein each joist comprises angle-iron members, and each mount comprises generally L-shaped brackets for being arranged in an opposing relationship relative to the angle-iron members, and further including a fastener for connecting the L-shaped brackets.

7. The apparatus of claim 1, wherein each mount comprises a bolt having a looped head for connecting to a first end of at least one cable of the plurality of cables.

8. The apparatus of claim 1, wherein at least one of the cables comprises a hook for engaging at least one of the mounts.

9. An apparatus for providing air circulation in a room including joists, comprising:

a fan; and a plurality of mounting brackets, each for connecting to one joist; and a plurality of cables, each for connecting the fan to one of the mounting brackets;

whereby the cables provide additional reinforcement and stability, enabling the fan to remain secure during seismic events, wherein the cables are connected to the fan by way of turnbuckles attached to a bracket located between a motor assembly and a gearbox of the fan.

10. The apparatus of claim 9, wherein the fan includes a support for supporting the fan from a ceiling of the room.

11. The apparatus of claim 10, wherein the support comprises an elongate, metal tube-like structure that couples the fan to the ceiling.

12. The apparatus of claim 9, wherein each mounting bracket is adapted to envelop a portion of the joist.

13. The apparatus of claim 9, wherein each mounting bracket comprises an adjustable bar, a pair of brackets, an eye bolt, bolts, and nuts.

14. The apparatus of claim 13, wherein each of the brackets includes a slot for receiving one of the bolts.

15. The apparatus of claim 9, wherein the fan comprises a hub assembly and fan blades, together having a diameter of between approximately 6 feet and approximately 24 feet.

16. The apparatus of claim 9, wherein each joist comprises angle-iron members, and the mounting bracket comprises generally L-shaped brackets for being arranged in an opposing relationship relative to the angle-iron members, and further including a fastener for connecting the L-shaped brackets.

17. The apparatus of claim 16, wherein the fastener comprises a bolt.

18. The apparatus of claim 16, wherein the fastener comprises an adjustable bar.

19. The apparatus of claim 9, further including a turnbuckle for connecting to one end of each cable.

20. The apparatus of claim 9, wherein a bracket on the fan is connected to one end of each cable.

21. An apparatus for providing air circulation in a room including joists, comprising:

a fan; and a plurality of mounting brackets, each for connecting to one joist; and a plurality of cables, each for connecting the fan to one of the mounting brackets; whereby the cables provide additional reinforcement and stability, enabling the fan to remain secure during seismic events, wherein the cables are attached to the fan between a motor assembly and a gearbox of the fan.

22. An apparatus for providing air circulation in a room including joists, comprising:

a fan; and a plurality of mounting brackets, each for connecting to one joist; and a plurality of cables, each for connecting the fan to one of the mounting brackets;

whereby the cables provide additional reinforcement and stability, enabling the fan to remain secure during seismic events;

wherein each mounting bracket comprises an adjustable bar, a pair of brackets, an eye bolt, bolts, and nuts;

wherein each of the brackets includes a slot for receiving one of the bolts.

* * * * *